US006257686B1

(12) United States Patent
Takahashi et al.

(10) Patent No.: US 6,257,686 B1
(45) Date of Patent: Jul. 10, 2001

(54) INK DROPLET EJECTING METHOD AND APPARATUS

(75) Inventors: Yoshikazu Takahashi, Nagoya; Hiroyuki Ishikawa, Nisshin, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/200,986

(22) Filed: Nov. 30, 1998

(30) Foreign Application Priority Data

Dec. 16, 1997 (JP) ..... 9-346721

(51) Int. Cl.[7] ..... B41J 29/38

(52) U.S. Cl. ..... 347/10; 347/10; 347/9; 347/11; 347/14; 347/69; 347/68

(58) Field of Search ..... 347/10, 9, 11, 347/14, 69, 68

(56) References Cited

U.S. PATENT DOCUMENTS

| | | | | |
|---|---|---|---|---|
| 4,743,924 | * | 5/1988 | Scardovi | 347/10 |
| 5,028,936 | * | 7/1991 | Bartky et al. | 347/69 |
| 5,736,994 | * | 4/1998 | Takahashi | 347/11 |
| 5,767,871 | * | 6/1998 | Imai | 347/10 |
| 5,805,177 | * | 9/1998 | Takahashi | 347/11 |
| 5,880,750 | * | 3/1999 | Takahashi | 347/10 |
| 5,903,286 | * | 5/1999 | Takahashi | 347/11 |
| 5,909,228 | * | 6/1999 | Takahashi | 347/10 |
| 5,975,667 | * | 11/1999 | Moriguchi et al. | 347/10 |
| 5,980,013 | * | 11/1999 | Takahashi | 347/14 |
| 6,059,393 | * | 5/2000 | Takahashi | 347/11 |
| 6,109,716 | * | 8/2000 | Takahashi | 347/11 |

FOREIGN PATENT DOCUMENTS

| | | |
|---|---|---|
| 63-247051 | 10/1988 | (JP) . |
| 9-48112 | 2/1997 | (JP) . |

* cited by examiner

*Primary Examiner*—John Barlow
*Assistant Examiner*—An H. Do
(74) *Attorney, Agent, or Firm*—Oliff & Berridge, PLC

(57) ABSTRACT

In an ink droplet ejecting method and apparatus, when a continuous dot printing is performed and also when a continuous dot printing is followed by a one-dot rest and again subsequent printing, it is intended to suppress the meniscus oscillation of ink, prevent the decrease in ink droplet ejecting speed of some dots and prevent the ink droplet ejecting direction from becoming unstable. A plurality of driving waveforms are provided in advance, and in accordance with whether there is ink ejection just before and just after one dot, an appropriate driving waveform for the dot is selected, whereby it becomes possible to suppress the meniscus oscillation of ink and a stable ink droplet ejection is ensured in a continuous dot printing and also when a continuous dot printing is followed by a one-dot rest and against subsequent printing.

15 Claims, 13 Drawing Sheets

FIRST DRIVING WAVEFORM

SECOND DRIVING WAVEFORM

FIRST DRIVING WAVEFORM

SECOND DRIVING WAVEFORM

THIRD DRIVING WAVEFORM 1
2
3
4
5

INK DROPLET EJECTING METHOD AND APPARATUS

BACKGROUND OF THE INVENTION

1. Field of the Invention

The invention relates to an ink droplet ejecting method and apparatus of an ink jet printhead.

2. Description of Related Art

According to a known ink jet printer using an ink jet printhead, the volume of an ink flow path is changed by deformation of a piezoelectric ceramic material, and when the flow path volume decreases, the ink present in the ink flow path is ejected as a droplet from a nozzle, while when the flow path volume increases, ink is introduced into the ink flow path from an ink inlet. In this type of printing head, a plurality of ink chambers are formed by partition walls of a piezoelectric ceramic material, and ink supply means, such as ink cartridges, are connected to one end of each ink chamber of the plurality of ink chambers, while at the opposite end of each of the ink chambers is an ink ejecting nozzle (hereinafter referred to simply as "nozzle" or "nozzles"). The partition walls are deformed in accordance with printing data to make the ink chambers smaller in volume, whereby ink droplets are ejected onto a printing medium from the nozzles to print, for example, a character or a figure.

As this type of an ink jet printer, a drop-on-demand type ink jet printer which ejects ink droplets is popular because of a high ejection efficiency and a low running cost. As an example of the drop-on-demand type there is known a shear mode type using a piezoelectric material, as is disclosed in Japanese Published Unexamined Patent Application No. Sho 63-247051.

As shown in FIGS. 12A–13, (which are also applicable to the instant invention), this type of an ink droplet ejecting apparatus 600 comprises a bottom wall 601, a top wall 602 and shear mode actuator walls 603 located therebetween. The actuator walls 603 each comprise a lower wall 607 bonded to the bottom wall 601 and polarized in the direction of arrow 611 and an upper wall 605 formed of a piezoelectric material, the upper wall 605 being bonded to the top wall 602 and polarized in the direction of arrow 609. Adjacent actuator walls 603, in a pair, define an ink chamber 613 therebetween, and next adjacent actuator walls 603, in a pair, define a space 615 which is narrower than the ink chamber 613.

A nozzle plate 617 (FIG. 12B) having nozzles 618 is fixed to one end of the ink chambers 613, while to the opposite end of the ink chambers is connected an ink supply source (not shown). On both side faces of each actuator wall 603 are formed electrodes 619, 621, respectively, as metallized layers. More specifically, the electrode 619 is formed on the actuator wall 603 on the side of the ink chamber 613, while the electrode 621 is formed on the actuator wall 603 on the side of the space 615. The surface of the electrode 619 is covered with an insulating layer 630 for insulation from the ink. The electrode 621 which faces the space 615 is connected to a ground 623, and the electrode 619 provided in each ink chamber 613 is connected to a controller 625 which provides an actuator drive signal to the electrode.

The controller 625 applies a voltage to the electrode 619 in each ink chamber, whereby the associated actuator walls 603 undergo a piezoelectric thickness slip deformation in directions to increase the volume of the ink chamber 613. For example, as shown in FIG. 13, when voltage E(V) is applied to an electrode 619*c* in an ink chamber 613*c*, electric fields are generated in the directions of arrows 629, 631 and 630, 632 respectively in actuator walls 603*e* and 603*f*, so that the actuator walls 603*e* and 603*f* undergo a piezoelectric thickness slip deformation in directions to increase the volume of the ink chamber 613*c*. At this time, the internal pressure of the ink chamber 613*c*, including a nozzle 618*c* and the vicinity thereof, decreases. The applied state of the voltage E(V) is maintained for only a one-way propagation time T of a pressure wave in the ink chamber 613*c*. During this period, ink is supplied from the ink supply source.

The one-way propagation time T is a time required for the pressure wave in the ink chamber 613 to propagate longitudinally through the ink chamber. Given that the length of the ink chamber 613 is L and the velocity of sound in the ink present in the ink chamber 613 is a, the time T is determined to be T=L/a.

According to the theory of pressure wave propagation, upon the lapse of time T, or an odd-multiple time thereof, after the above application of voltage, the internal pressure of the ink chamber 613*c* reverses into a positive pressure. In conformity with this timing, the voltage being applied to the electrode 619*c* in the ink chamber 613*c* is returned to 0 (V). As a result, the actuator walls 603*e* and 603*f* revert to their original state (FIG. 13) before the deformation, whereby a pressure is applied to the ink. At this time, the above positive pressure and the pressure developed by reverting of the actuator walls 603*e* and 603*f* to their original state before the deformation are added together to afford a relatively high pressure in the vicinity of the nozzle 618*c* in the ink chamber 613*c*, whereby an ink droplet is ejected from the nozzle 618*c*. An ink supply passage 626 communicating with the ink chamber 613 is formed by members 627, 628.

Heretofore, in this type of an ink droplet ejecting apparatus 600, when jet pulses (an optimum pulse width is an odd-multiple value of T) are applied to an actuator continuously at a predetermined frequency to effect a continuous dot printing and when the continuous dot printing is followed by, for example, a one-dot rest and subsequent input of the next dot printing instruction, the ink droplet speed and the direction of droplet ejection become unstable at the portion of the printing instruction under the influence of remaining meniscus oscillation of the ink present in the nozzle concerned, thus giving rise to the problem that a printing line is curved or thinned at that portion, resulting in deterioration of the print quality.

In the case where an ink droplet of a small volume is to be ejected for enhancing the printing resolution, it has been proposed to add, for one dot, a non-jet pulse after application of a jet pulse and before completion of ink ejection. In this case, the remaining meniscus oscillation is suppressed and the ejection of ink becomes stable in a continuous dot printing, but there arises the problem that the energy efficiency is low because it is necessary to continue adding the non-jet pulse. In both cases noted above, the printing instruction is issued without considering whether there is ejection of ink just before and just after the dot concerned.

Now, with reference to FIGS. 1A, 1B and FIGS. 2 and 3, a description will be given of results obtained by conducting two printing operations and actually measuring ink droplet ejecting speeds. FIG. 1A shows a jet pulse signal A (designated the first driving waveform) of pulse width 1 T for one dot and FIG. 1B shows the jet pulse signal A of pulse width 1 T for one dot and a non-jet additional pulse signal B (both designated the second driving waveform). In this case, a time difference between a fall timing of the jet pulse signal A and a rise timing of the additional pulse signal B is set at 2.25 T and that the pulse width of the additional pulse signal B is set at 0.5 T. Here there was used a certain waveform (the first or the second driving waveform) irrespective of whether there is ejection of ink. Table 1 below shows measurement data on the ink droplet ejecting speed (m/s) obtained by a continuous dot printing (1~5) with use of each driving waveform, subsequent one-dot rest (6) and subsequent two-dot printing (7, 8). Printing frequency was set at 10.0 kHz. As is seen from Table 1, the ink droplet ejecting speed greatly decreases at the second dot (8) after the rest which follows the continuous printing using the first driving waveform.

TABLE 1

| DRIVING | DOT | | | | | | | |
|---|---|---|---|---|---|---|---|---|
| WAVEFORM | 1 | 2 | 3 | 4 | 5 | 6 | 7 | 8 |
| 1ST DRIVING WAVEFORM | 8.0 | 9.0 | 9.5 | 9.5 | 9.5 | — | 9.2 | 6.5 |
| 2ND DRIVING WAVEFORM | 8.0 | 7.5 | 8.1 | 8.1 | 8.1 | — | 8.0 | 7.5 |

In the case where printing is performed at a high frequency in such a manner that a continuous dot printing is followed by a one-dot rest and subsequent printing with plural dots, there arises the problem that the second dot after the rest cannot be ejected or the ink droplet of the second dot becomes smaller in continuous dot printing.

SUMMARY OF THE INVENTION

The invention addresses and solves the above-identified problems. According to the invention, the driving waveform for printing the dot concerned is changed according to whether there is ejection of ink just before and just after the printing, whereby in a continuous dot printing and when a continuous dot printing is followed by a one-dot rest and again subsequent printing, it becomes possible to suppress the meniscus oscillation of the ink and the decrease in ink droplet ejecting speed of some dots is prevented. The instability of the droplet ejecting direction is also prevented. In addition, the driving energy efficiency is improved. It is an object of the invention to provide an ink droplet ejecting method and apparatus capable of attaining these results.

For achieving the above-mentioned object, the invention resides in an ink droplet ejecting method wherein a jet pulse signal is applied to an actuator which is for changing the volume of an ink chamber filled with ink, to generate a pressure wave within the ink chamber, thereby applying pressure to the ink and allowing a droplet of the ink to be ejected from a nozzle, wherein, on the basis of whether there is ejection of ink just before and just after one dot, a driving waveform which forms the one dot is deformed.

In this method, the state of ink meniscus in printing the dot differs according to whether there is ejection of ink just before and just after the dot. However, since the driving waveform of the dot is changed according to whether there is ejection of ink just before and just after the dot, it becomes possible to stabilize the meniscus, and when printing is started again after a continuous dot printing or after a one-dot rest in the continuous dot printing, the decrease in ink droplet ejecting speed is prevented and the ink ejecting direction is stabilized.

The invention resides in an ink droplet ejecting method, wherein two to four types of driving waveforms are provided in advance as jet pulse signals to be applied to the actuator at a predetermined cyclic timing in accordance with a one dot or plural continuous dots printing instruction, and any of the pre-provided driving waveforms is selected on the basis of whether there is ejection of ink just before and just after one dot.

According to this method, a suitable driving waveform of one dot is selected from among several pre-provided driving waveforms on the basis of whether there is ejection of ink just before and just after the dot. By so doing, an appropriate driving waveform can be selected easily and there are attained the same effects as above.

The invention resides in an ink droplet ejecting method, wherein if there is ejection of ink just after the dot, ink ejection is performed using a first driving waveform comprising one or plural jet pulses, while if there is no ejection of ink just after the dot, ink ejection is performed using a second driving waveform which comprises the first driving waveform and a non-jet pulse added after the first driving waveform.

According to this method, it is possible to stabilize the dot ejection in the case where there is no ejection of ink just after the dot. Besides, it becomes unnecessary to always add a non-jet pulse for one dot.

The invention resides in an ink droplet ejecting method, wherein if there is ejection of ink just before the dot and there is no ejection of ink just after the dot, the wave width of the jet pulse is shifted from an odd-multiple of time T required for one-way propagation of the pressure wave through the ink chamber, and in other cases the wave width of the jet pulse is set at an odd-multiple of the one-way propagation time T.

According to this method, when continuous dots are subjected to printing with a cycle of time T and when the wave width of one-dot jet pulse is set at an odd-multiple (say, 1 T or 3 T) of time T, the pressure increases in relation to propagation of the pressure wave and the ink droplet ejecting speed increases, while if the wave width is shifted from an off-multiple time, say 1.5 T, the pressure does not increase and the droplet ejecting speed decreases. Therefore, by adopting the above driving waveform for a dot not immediately followed by dot ejection, it is possible to suppress the residual meniscus oscillation and the droplet ejecting speed can be stabilized.

The invention resides in an ink droplet ejecting method, wherein if there is ejection of ink just before and just after the dot, ink ejection is performed at a frequency at which the ink droplet ejecting speed remains the same or increases, and in other cases ink ejection is performed at a frequency at which the ink droplet ejecting speed decreases.

According to this method, in continuous printing, the frequency of a driving signal for some dots is slightly increased or decreased with respect to a predetermined printing frequency, with the result that the dot ejection timing changes at that dot portion. Consequently, the influence on the residual meniscus oscillation changes and so does the droplet ejecting speed. In view of this point, a dot not followed by dot ejection before or after the dot is driven at a frequency at which the droplet ejecting speed decreases (the ejection timing becomes faster), whereby the influence of the residual meniscus oscillation can be diminished and it is possible to stabilize the droplet ejecting speed.

The invention resides in an ink droplet ejecting apparatus including an ink chamber filled with ink, an actuator for changing the volume of the ink chamber, a driving power source for applying an electric signal to the actuator, and a controller which makes control so that a jet pulse signal is applied to the actuator from the driving power source to increase the volume of the ink chamber and thereby generate a pressure wave in the ink chamber and so that when the time required for one-way propagation of the pressure wave through the ink chamber is assumed to be T, the volume of the ink chamber is decreased from the increased state to a normal state after the lapse of an odd-multiple of the time T, thereby applying pressure to the ink present in the ink chamber and allowing an ink droplet to be ejected, wherein the controller control is such that, in accordance with a one-dot printing instruction and on the basis of whether there is ejection of ink just before and just after the one dot, a driving waveform which forms the one dot is deformed and a jet pulse signal of the driving waveform is applied to the actuator from the driving power source. This structure affords the same effects as the first aspect of the invention.

The invention resides in an ink droplet ejecting apparatus, wherein two or four types of driving waveforms are provided in advance as jet pulse signals to be applied to the actuator at a predetermined cyclic timing in accordance with a one dot or plural continuous dots printing instruction, and any of the pre-provided driving waveforms is selected on the basis of whether there is ejection of ink just before and just after one dot. This structure affords the same effects as the second aspect of the invention.

The invention resides in an ink droplet ejecting apparatus, wherein if there is ejection of ink just after the dot, ink ejection is performed using a first driving waveform comprising one or plural jet pulses, while if there is no ejection of ink just after the dot, ink ejection is performed using a second driving waveform which comprises the first driving waveform and a non-jet pulse added after the first driving waveform. This structure affords the same effects as the third aspect of the invention.

The invention resides in an ink droplet ejecting apparatus wherein, if there is ejection of ink just before the dot and there is no ejection of ink just after the dot, the wave width of the jet pulse is shifted from an odd-multiple of time T required for one-way propagation of the pressure wave through the ink chamber, and in other cases the wave width of the jet pulse is set at an odd-multiple of the one-way propagation time T. This structure affords the same effects as the fourth aspect of the invention.

The invention resides in an ink droplet ejecting apparatus, wherein if there is ejection of ink just before and just after the dot, ink ejection is performed at a frequency at which the ink droplet ejecting speed remains the same or increases, and in other cases ink ejection is performed at a frequency at which the ink droplet ejecting speed decreases. This structure affords the same effects as the fifth aspect of the invention.

According to the ink droplet ejecting method and apparatus according to the invention, as set forth above, the driving waveform for printing a dot is changed in accordance with whether there is ejection of ink just before and just after the dot, whereby in a continuous printing and when a continuous dot printing is followed by a one-dot rest and again subsequent printing, it becomes possible to suppress the meniscus oscillation of ink and prevent the decrease in ink droplet ejecting speed of some dots and the destabilization of the droplet ejecting direction. Moreover, the driving energy efficiency is improved because it is not necessary to always add a non-jet pulse to one dot.

BRIEF DESCRIPTION OF THE DRAWINGS

A preferred embodiment of the invention will be described in detail with reference to the following figures wherein.

DETAILED DESCRIPTION OF THE PREFERRED EMBODIMENTS

Figure 1A:
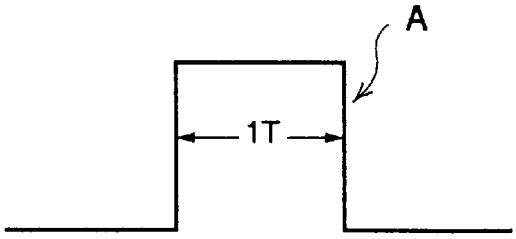
FIG. 1A is a diagram showing a jet pulse signal waveform for one dot.

Embodiments of the invention will be described below with reference to the drawings. The structure of the mechanical portion in the ink droplet ejecting apparatus embodying the invention is the same as that shown in FIGS. 12A, 12B and 13, previously described. Therefore an explanation thereof is here omitted.

An example of dimensions of the ink droplet ejecting apparatus, indicated at 600, will be described. The length L of the ink chamber 613 is 7.5 mm. As to the dimensions of the nozzle 618, its diameter on an ink droplet ejection side is 40 $\mu$m, its diameter on the ink chamber 613 side is 72 $\mu$m, and its length is 100 $\mu$m. The viscosity, at 25° C., of ink used in an experiment is about 2 mPas and the surface tension thereof is 30 mN/m. The ratio of the above length L to a sonic velocity, a, in the ink present within the ink chamber 613, i.e., L/a (=T), was 8 $\mu$sec.

The driving waveform to be applied to an electrode 619 in the ink chamber 613 used in this apparatus is outputted at a predetermined cyclic timing in accordance with a single dot or plural continuous dots printing instruction, and there is selected any of several types (2 to 4) of driving waveforms which are provided in advance on the basis of whether there is ejection of ink just before or just after one dot, i.e., the current dot for printing.

Figure 1B:
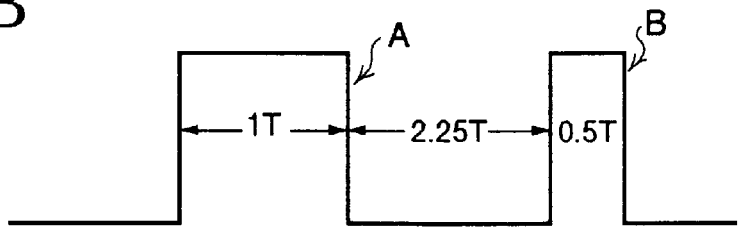
FIG. 1B is a diagram showing both jet pulse signal waveform and non-jet additional pulse signal waveform for one dot.

Table 2 below shows driving waveform conditions used in the first embodiment. In the table, the first and second driving waveforms are those shown in FIGS. 1A and 1B, respectively. The driving waveforms of FIGS. 1A and 1B are pulses for one dot printing, of which FIG. 1A comprises a jet pulse signal A (the first driving waveform) having a pulse width of an odd-multiple of 1 T, and FIG. 1B comprises the jet pulse signal A and a non-jet pulse B (the second driving waveform) which follows application of the jet pulse signal A. In the first embodiment, if there is ejection of ink immediately after one dot has been printed, ink ejection is performed using the first driving waveform, while if there is no ejection of ink immediately after the one dot, ink ejection is performed using the second driving waveform. Peak values (voltage values) of the jet pulse signal A and the additional pulse B are both assumed to be E(V), for example, say 20 (V).

TABLE 2

| PRECEEDING DOT | FOLLOWING DOT | DRIVING WAVEFORM FOR CURRENT DOT |
|---|---|---|
| ON | ON | 1ST DRIVING WAVEFORM |
| ON | OFF | 2ND DRIVING WAVEFORM |
| OFF | ON | 1ST DRIVING WAVEFORM |
| OFF | OFF | 2ND DRIVING WAVEFORM |

In this case, the wave width of the jet pulse signal A is set equal to an odd-multiple, a value peculiar to a head, of the ratio, L/a (=T), of the above length L to a sonic velocity, a, in the ink present within the ink chamber 613. A time difference between a fall timing of the jet pulse signal A and a rise timing of the additional pulse B, as well as the wave width of the additional pulse B, are as noted previously. The cycle of pulses in the case of printing the next dot in a continuous manner is assumed to be approximately an even-multiple of T, which is set so that the residual oscillation based on the jet pulse signal A promotes the next ink ejection. For example, the pulse cycle is 100 $\mu$sec, assuming that the driving frequency is 10 kHz.

TABLE 3

| DRIVING WAVEFORM | DOT 1 | 2 | 3 | 4 | 5 | 6 | 7 | 8 |
|---|---|---|---|---|---|---|---|---|
| DRIVING WAVEFORM DETERMINED BY TABLE 2 | 8.0 | 9.0 | 9.5 | 9.5 | 9.5 | — | 9.2 | 8.7 |

Figure 2:
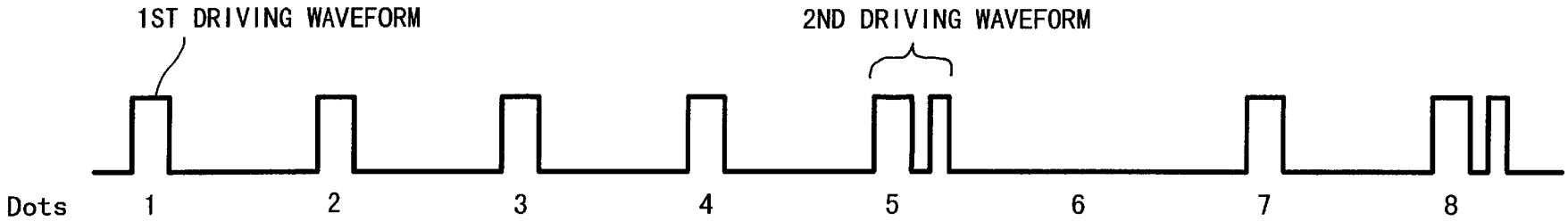
FIG. 2 is a diagram showing the driving waveforms used in a first embodiment of the invention.

Table 3 above shows measurement data on the ink droplet ejecting speed (m/s) obtained by performing printing continuously (with a one-dot rest halfway) with use of the first or the second driving waveform under the driving waveform conditions in the first embodiment shown in Table 2 above. The printing frequency was set at 10.0 kHz. In the same manner as in Table 1, printing was conducted by a continuous dot printing (1~5), subsequent one-dot rest (6) and subsequent continuous dot printing (7, 8). FIG. 2 shows the driving waveform applied to this example. For the fifth and eighth dots, the second driving waveform was used because neither was immediately followed by dot ejection, and for the other dots there was used the first driving waveform. A comparison of the data with the data obtained by using only the first driving waveform in Table 1 shows that the eighth dot ejection not immediately followed by dot ejection does not decrease so much and that the eighth ejection is stable. Besides, in comparison with the use of only the second driving waveform with the conventional art, the second dot ejecting speed in the first embodiment does not decrease. Moreover, the energy efficiency is improved because the second driving waveform with a non-jet pulse added thereto is not normally in use. Further, an appropriate driving waveform can be selected easily from among several types of driving waveforms which are provided in advance.

Figure 3:
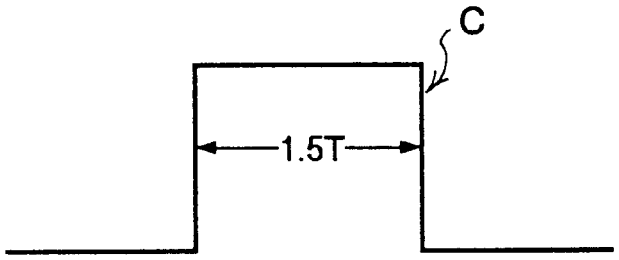
FIG. 3 is a diagram showing a third driving waveforms used in the second embodiment of the invention.

FIG. 3 shows one jet pulse signal C (a third driving waveform, pulse width: 1.5 T) used in a second embodiment and Table 4 shows driving waveform conditions used in the second embodiment. Either the first or the third driving waveform is used according to whether there is ejection of an ink dot just before and just after the one dot. The third driving waveform is used in the case where there is ejection of ink just before the one dot to be printed and there is no ejection of ink just after. In other cases the first driving waveform is used.

TABLE 4

| PRECEEDING DOT | FOLLOWING DOT | DRIVING WAVEFORM FOR CURRENT DOT |
|---|---|---|
| ON | ON | 1ST DRIVING WAVEFORM |
| ON | OFF | 3RD DRIVING WAVEFORM |
| OFF | ON | 1ST DRIVING WAVEFORM |
| OFF | OFF | 1ST DRIVING WAVEFORM |

Table 5 shows measurement data on the ink droplet ejecting speed (m/s) obtained by performing printing in a continuous manner (with a one-dot rest halfway) with respect to the case where only the third driving waveform was used and the case (Example) where either the first or the third driving waveform is used according to the driving waveform conditions in the second embodiment shown in Table 4.

TABLE 5

| DRIVING WAVEFORM | DOT 1 | 2 | 3 | 4 | 5 | 6 | 7 | 8 |
|---|---|---|---|---|---|---|---|---|
| 3RD DRIVING WAVEFORM | 6.0 | 6.8 | 7.1 | 7.1 | 7.1 | — | 6.9 | 4.9 |
| DRIVING WAVEFORM DETERMINED BY TABLE 4 | 8.0 | 9.0 | 9.5 | 9.5 | 7.9 | — | 8.0 | 8.5 |

Figure 4:
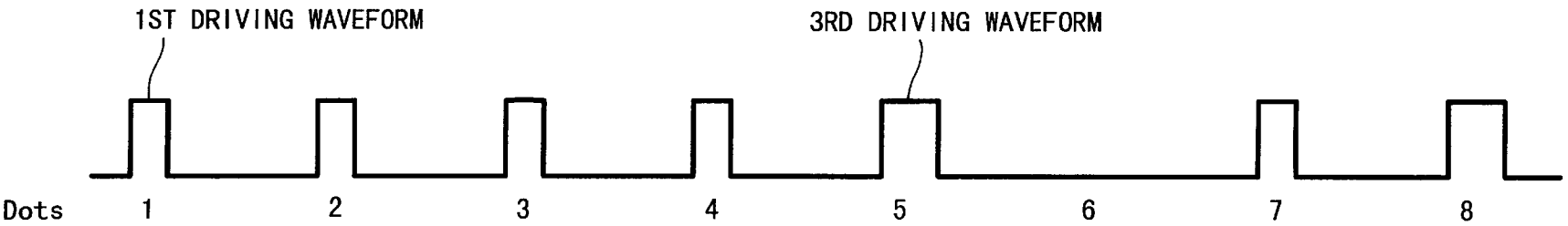
FIG. 4 is a diagram showing the driving waveforms used in the second embodiment.
Figure 5A:
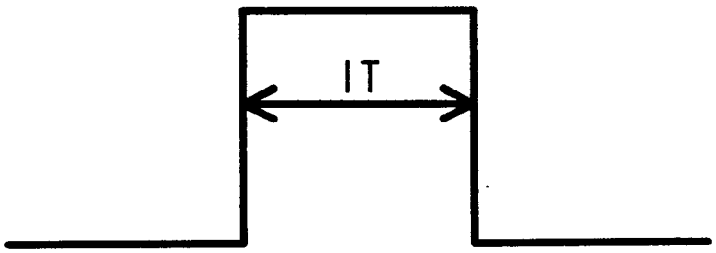
FIGS. 5A–5D are diagrams showing driving waveforms according to a further embodiment of the invention.
Figure 5B:
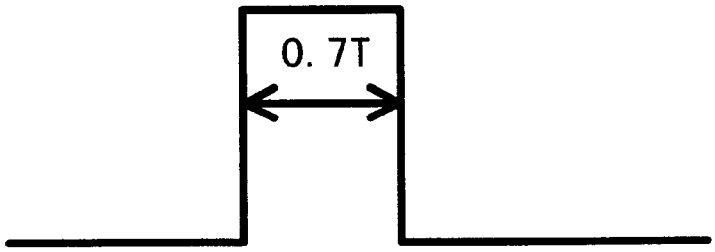
Figure 5C:
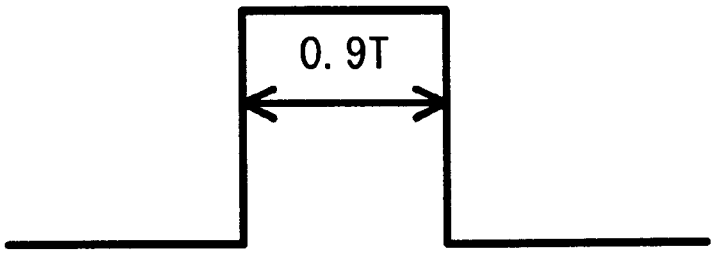
Figure 5D:
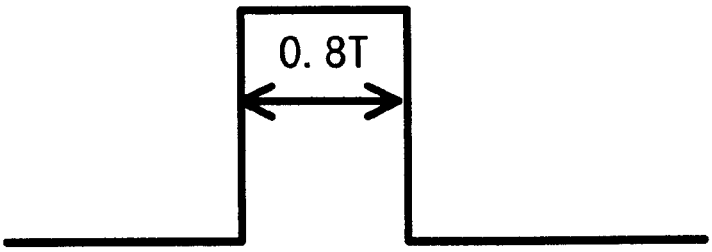

FIG. 4 shows the driving waveform applied to the example of Table 5, bottom row. For the fifth and eighth dots, the third driving waveform is used because there is ink ejection just before and no ink ejection just after the respective dots. For the other dots there is used the first driving waveform. A comparison of the Example with the use of only the third driving waveform shows that the ejection speed of the eighth dot not immediately followed by dot ejection exhibits no decrease, proving stable ejection.

In the second embodiment, the wave width of the jet pulse in the first driving waveform is set equal to an odd-multiple (say 1 T or 3 T) of time T required for one-way propagation of a pressure wave through the ink chamber, while in the third driving waveform the wave width of the jet pulse is shifted, for example, say 1.5 T, from an odd-multiple of the time T. If continuous dots are subjected to printing with a cycle of time T and if the jet pulse wave width of one dot is assumed to be an odd-multiple of time T, the pressure increases and the ejection speed also increases in relation to propagation of the pressure wave, while if the wave width is shifted from the odd-multiple, the pressure does not increase and the ejection speed decreases. Therefore, for a dot not immediately followed by dot ejection, there is adopted such a driving waveform as mentioned above, whereby it is possible to dampen the residual oscillation of the meniscus and stabilize the ejection speed.

TABLE 6

| PRECEEDING DOT | FOLLOWING DOT | PRINTING FREQUENCY FOR CURRENT DOT |
|---|---|---|
| ON | ON | 10.0 KHZ |
| ON | OFF | 10.8 KHZ |
| OFF | ON | 10.8 KHZ |
| OFF | OFF | 10.8 KHZ |

Table 6 above shows driving wave conditions used in the third embodiment of the invention. If there is ejection of ink just before and just after one dot to be printed, ink ejection is performed at a frequency (say 10.0 kHz as will be described later) at which the ink droplet ejecting speed remains the same or increases, and in other cases ink ejection is performed at a frequency (say 10.8 kHz) at which the ink droplet ejecting speed decreases. The first driving waveform is used in both cases. Table 7 below shows measurement data on the ink droplet ejecting speed (m/s) obtained by performing printing continuously, with a one-dot rest halfway, with respect to the case where ink ejection is conducted at plural frequencies of 10.0 kHz or so and the case where ink ejection is conducted at frequencies according to the driving waveform conditions in the third embodiment shown in Table 6.

TABLE 7

| FREQUENCY | DOT | | | | | | | |
|---|---|---|---|---|---|---|---|---|
| [kHz] | 1 | 2 | 3 | 4 | 5 | 6 | 7 | 8 |
| 9.2 | 8.0 | 9.5 | 10.0 | 10.0 | 10.0 | — | 9.7 | 6.8 |
| 9.6 | 8.0 | 9.3 | 9.8 | 9.8 | 9.8 | — | 9.5 | 6.6 |
| 10.0 | 8.0 | 9.0 | 9.5 | 9.5 | 9.5 | — | 9.2 | 6.5 |
| 10.4 | 8.0 | 8.2 | 9.0 | 9.0 | 9.0 | — | 8.6 | 6.1 |
| 10.8 | 8.0 | 7.0 | 8.1 | 8.1 | 8.1 | — | 7.8 | 5.6 |
| 11.2 | 8.0 | 7.5 | 8.7 | 8.7 | 8.7 | — | 8.6 | 6.8 |
| 11.6 | 8.0 | 8.2 | 9.2 | 9.2 | 9.2 | — | 9.0 | 6.4 |
| FREQUENCY DETERMINED BY TABLE 6 | 8.0 | 9.5 | 9.6 | 9.6 | 9.5 | — | 8.8 | 9.1 |

As is seen from the measurement data of Table 7, when the frequency of 10.0 kHz is used, the ink droplet ejecting speed in the second dot ejection is higher than that in the first dot ejection, while at the frequency of 10.8 kHz the droplet ejecting speed in the second dot ejection is lower than that in the first dot ejection. The reason why the ejection speed varies is that the frequency of a driving signal in a certain dot ejection increases or decreases slightly in continuous printing relative to a predetermined printing frequency, resulting in the dot ejection timing being changed at the dot portion concerned, and that therefore the influence on the residual meniscus oscillation changes. Accordingly, the dots not preceded by or not followed by dot ejection, here the first and fifth dots, as well as the seventh and eighth dots, are ejected at a frequency (10.8 kHz) at which the ejection speed decreases, whereby the ejection timing is faster (by 7.4 $\mu$s) and dot ejection can be carried out at a time point where the meniscus oscillation is small, so that the ejection speed can be stabilized. The reason why the ejection timing becomes faster by 7.4 $\mu$s is because the pulse cycle is 100 $\mu$s at 10.0 kHz and is 92.6 $\mu$s at 10.8 kHz. The second dot is ejected substantially at 9.3 kHz.

FIGS. 5A–5D show driving waveforms (driving voltage constant) used in another embodiment of the invention.

TABLE 8

| PRECEEDING DOT | FOLLOWING DOT | PULSE WIDTH OF DRIVING WAVEFORM FOR CURRENT DOT |
|---|---|---|
| ON | ON | 1 T |
| ON | OFF | 0.7 T |
| OFF | ON | 0.9 T |
| OFF | OFF | 0.8 T |

In the same figure, driving voltages of jet pulses for the dot concerned are shown under the conditions of FIGS. 5A to 5D. If the jet pulse width T in FIG. 5A with dots present just before and just after the dot concerned is assumed to be a reference pulse width, the jet pulse width in FIG. 5B with a dot present just before and no dot present just after the dot concerned may be made shorter than that in FIG. 5A, the jet pulse width in FIG. 5C with no dot present just before and a dot present just after the dot concerned may be made longer than that in FIG. 5B and shorter than T (FIG. 5A), and the jet pulse width in FIG. 5D with no dot present just before and after the dot concerned may be as short as that in FIG. 5B. The change of voltage waveform is not limited to the above examples. For example, the waveform of FIG. 5C may become equal to the waveform of FIG. 5A, or the waveforms of FIGS. 5B and 5D may be different, according to various conditions, including the shape of an ink flowing path. This is also the case with the following embodiments illustrated in FIGS. 6A–6D and 7A–7D.

FIGS. 6A–6D show driving waveforms used in a still further embodiment of the invention, in which the voltage value of the jet pulse is changed according to whether a dot is present just before and/or just after a dot of concern. The conditions of use of the driving waveforms are shown in Table 9 below.

TABLE 9

| PRECEEDING DOT | FOLLOWING DOT | DRIVING VOLTAGE OF DRIVING WAVEFORM FOR CURRENT DOT |
|---|---|---|
| ON | ON | 20 V |
| ON | OFF | 15 V |
| OFF | ON | 19 V |
| OFF | OFF | 18 V |

Figure 6A:
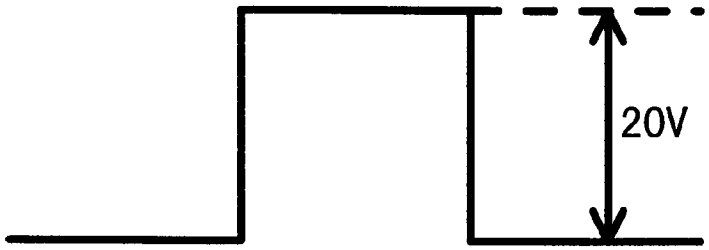
FIGS. 6A–6D are diagrams showing driving waveforms according to a still further embodiment of the invention.
Figure 6B:
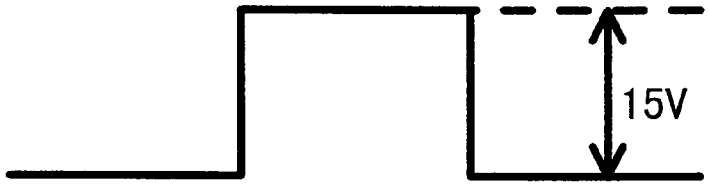
Figure 6C:
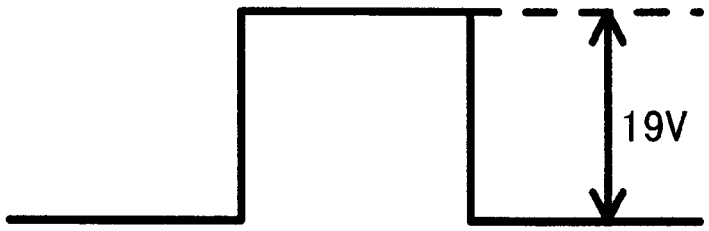
Figure 6D:
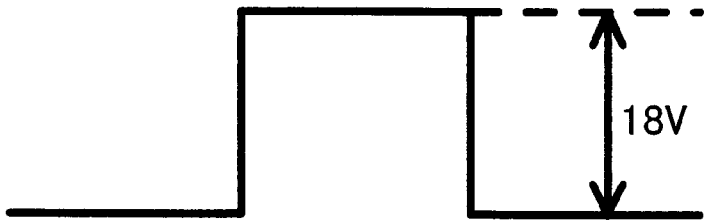

If a peak value of jet pulse in FIG. 6A with dot present before and just after a dot concerned is assumed to be a reference peak value, there may be adopted such peak values as illustrated in the same figure under the same conditions as above.

FIGS. 7A–7D shows driving waveforms used in a still further embodiment of the invention, in which inclinations at the leading and trailing edges of the jet pulse are changed according to whether a dot is present just before and/or just after a dot of concern. The conditions of use of the driving waveforms of FIGS. 7A–7D are shown in Table 10 below.

TABLE 10

| PRECEEDING DOT | FOLLOWING DOT | DELAY TIME OF LEADING EDGE FOR CURRENT DOT | DELAY TIME OF TRAILING EDGE FOR CURRENT DOT |
|---|---|---|---|
| ON | ON | 0 | 0 |
| ON | OFF | 0.25 T | 0 |
| OFF | ON | 0.1 T | 0 |
| OFF | OFF | 0 | 0.25 T |

Figure 7A:
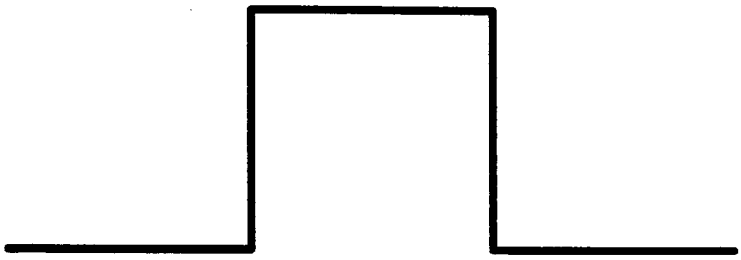
FIGS. 7A–7D are diagrams showing driving waveforms according to a still further embodiment of the invention.
Figure 7B:
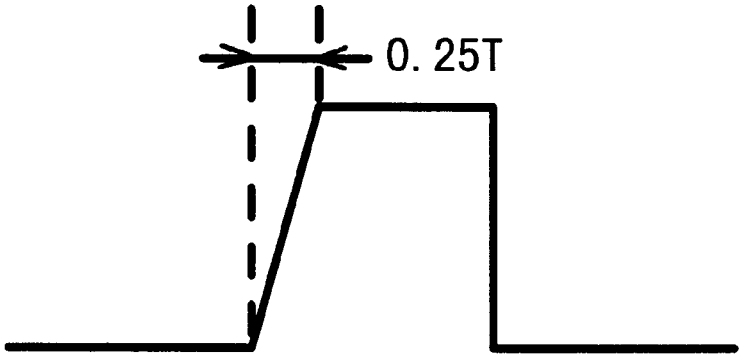
Figure 7C:
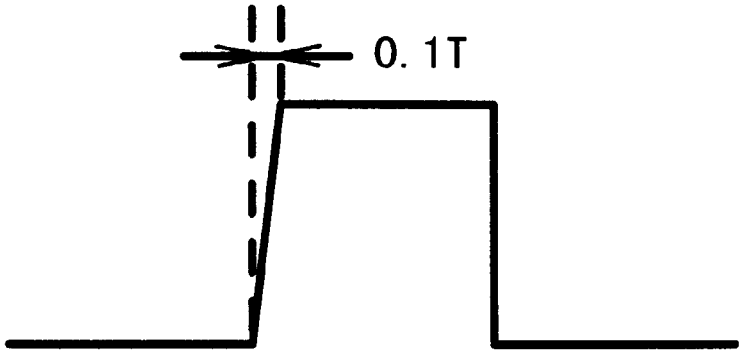
Figure 7D:
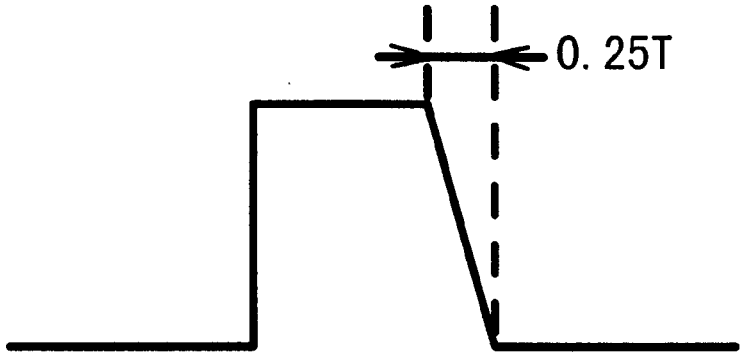

If such a jet pulse as in FIG. 7A with a dot present before and just after the dot of concern is made a reference pulse, there may be adopted such pulse waveforms as have the illustrated inclinations under the same conditions as above.

Figures 8A, 8B, 8C:
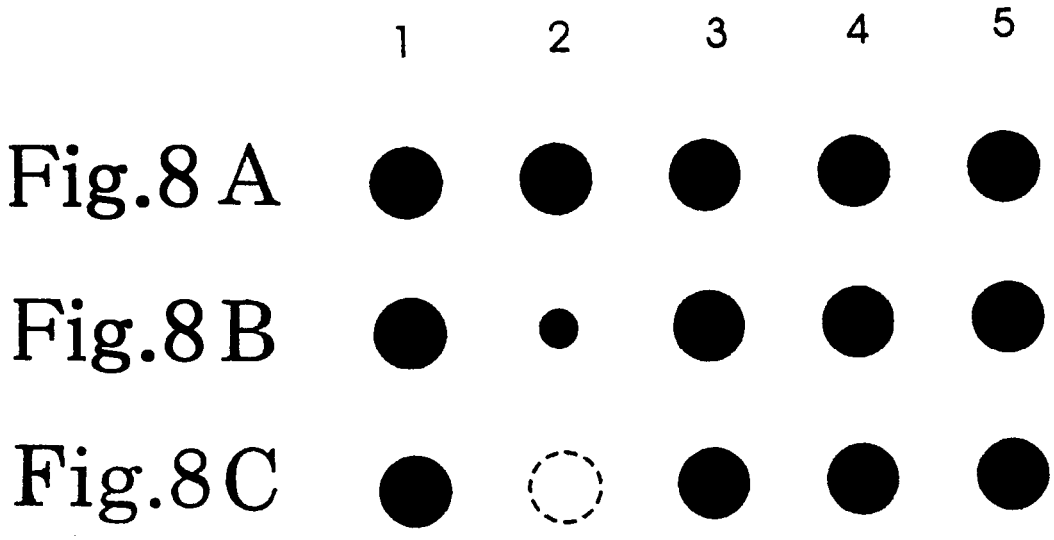
FIGS. 8A–8C are diagrams showing a satisfactory state of printing in a continuous dot ejection in FIG. 8A and FIGS. 8B and 8C are diagrams each showing an unsatisfactory state of printing in a continuous dot ejection.

All of the above measurement data have been obtained taking note of the case where a continuous dot ejection is followed by a one-dot rest and subsequent dot ejection. FIGS. 8A–8C illustrate a continuous dot ejection, in which FIG. 8A shows a satisfactory state of a continuous dot printing and FIGS. 8B and 8C each show the state of a continuous dot printing performed at a frequency of, say, 10.8 kHz without any change of jet pulse. From FIGS. 8B and 8C it is seen that the droplet volume of the second dot is small, affording a thin print, or there occurs a drop-out of a dot, respectively. Such a problem is apt to occur when printing is performed at a high frequency.

In the invention, as described in the above embodiments, the driving waveform (voltage, pulse width, the number of pulse) is changed in accordance with whether a dot is present just before and/or just after the dot concerned, thereby affording the favorable printing result shown in FIG. 8A.

Figure 9:
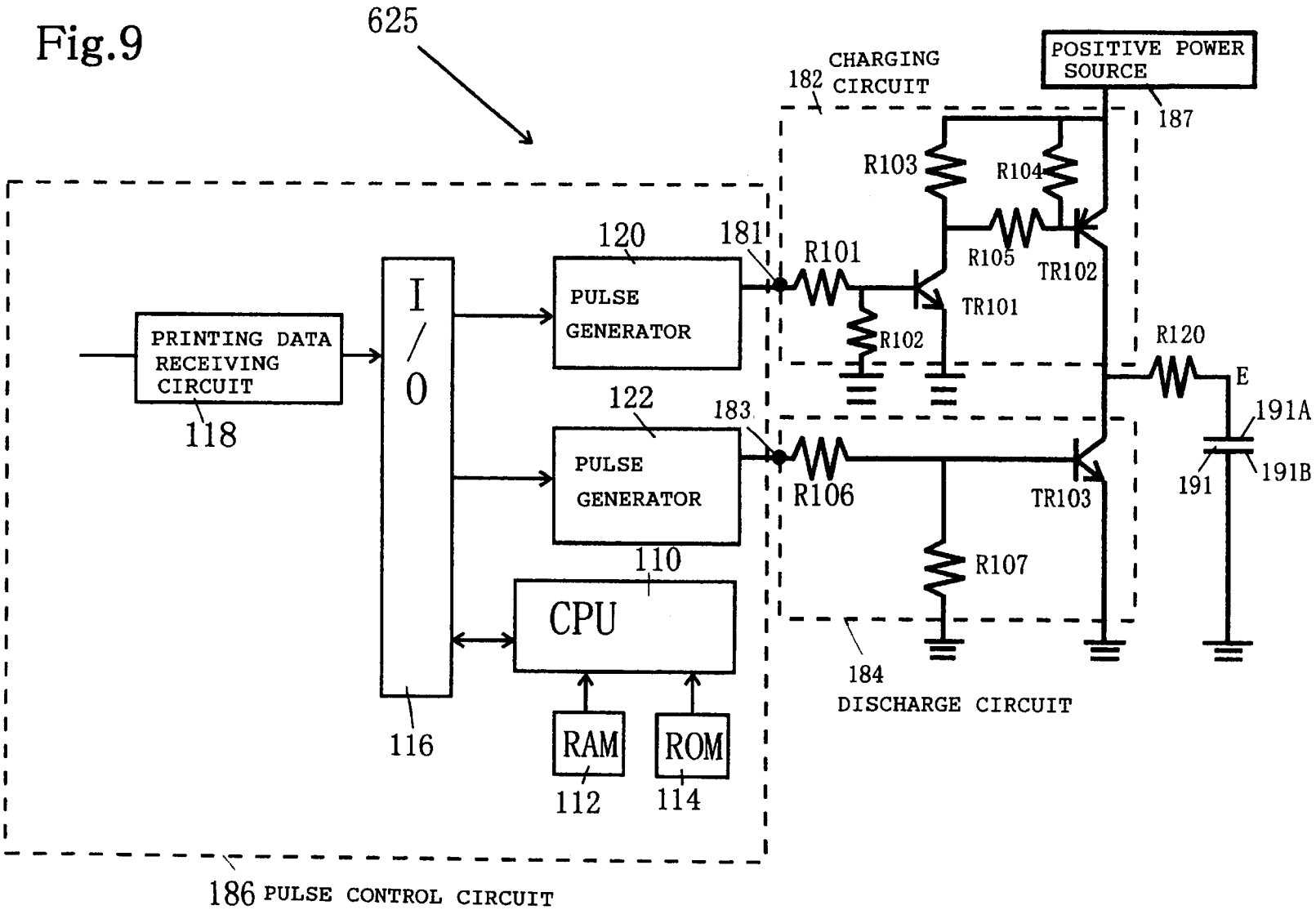
FIG. 9 is a diagram showing a drive circuit in an ink droplet ejecting apparatus embodying the invention.

Now, an example of a controller for implementing such various driving waveforms as discussed above will be described with reference to FIGS. 9 and 10. A controller 625 shown in FIG. 9 comprises a charging circuit 182, a discharge circuit 184 and a pulse control circuit 186. The piezoelectric material of the actuator wall 603 and electrodes 619, 621 are represented equivalently by a capacitor 191. Numerals 191A, 191B denote terminals thereof.

Input terminals 181, 183 are for inputting pulse signals to adjust the voltage to be applied to the electrode 619 in each ink chamber, to E(V) or 0(V). The charging circuit 182 comprises resistors R101, R102, R103, R104, R105 and transistors TR101, TR102.

When an ON signal (+5V) is applied to an input terminal 181, the transistor TR101 conducts through resistor R101, so that an electric current flows from a positive power source 187, passes through resistor R103, and flows from the collector to the emitter of transistor TR101. Consequently, a divided voltage of the voltage applied to the resistors R104, R105 which are connected to the positive power source 187 increases and so does the electric current flowing in the base of the transistor TR102, providing conduction between the emitter and the collector of the transistor TR102. A voltage of 20 (V) from the positive power source 187 is applied to the capacitor 191 and terminal 191A via the collector and emitter of the transistor TR102 and resistor R120.

Figure 12A:
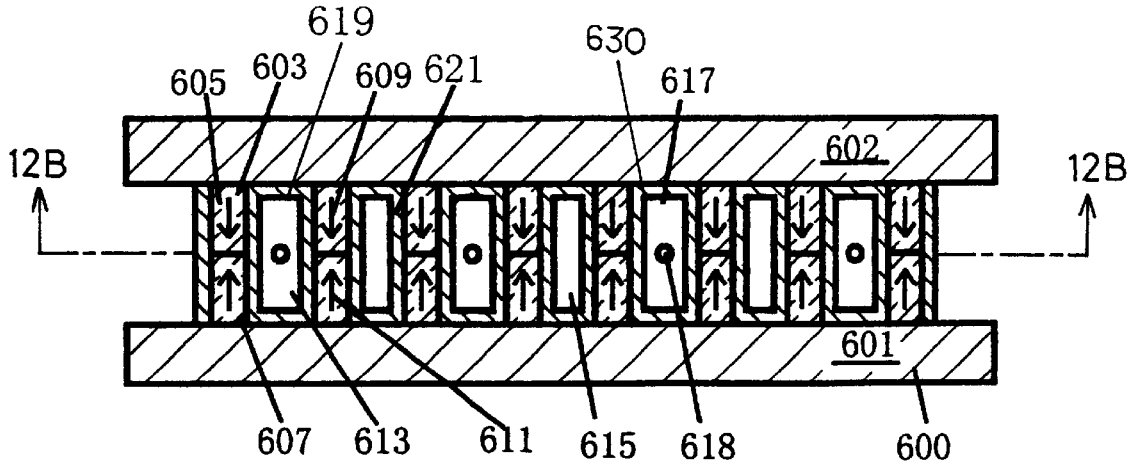
FIG. 12A is a longitudinal sectional view of an ink jet portion of a printing head and FIG. 12B is a transverse sectional view thereof take along 12B—12B of FIG. 12A.
Figure 12B:
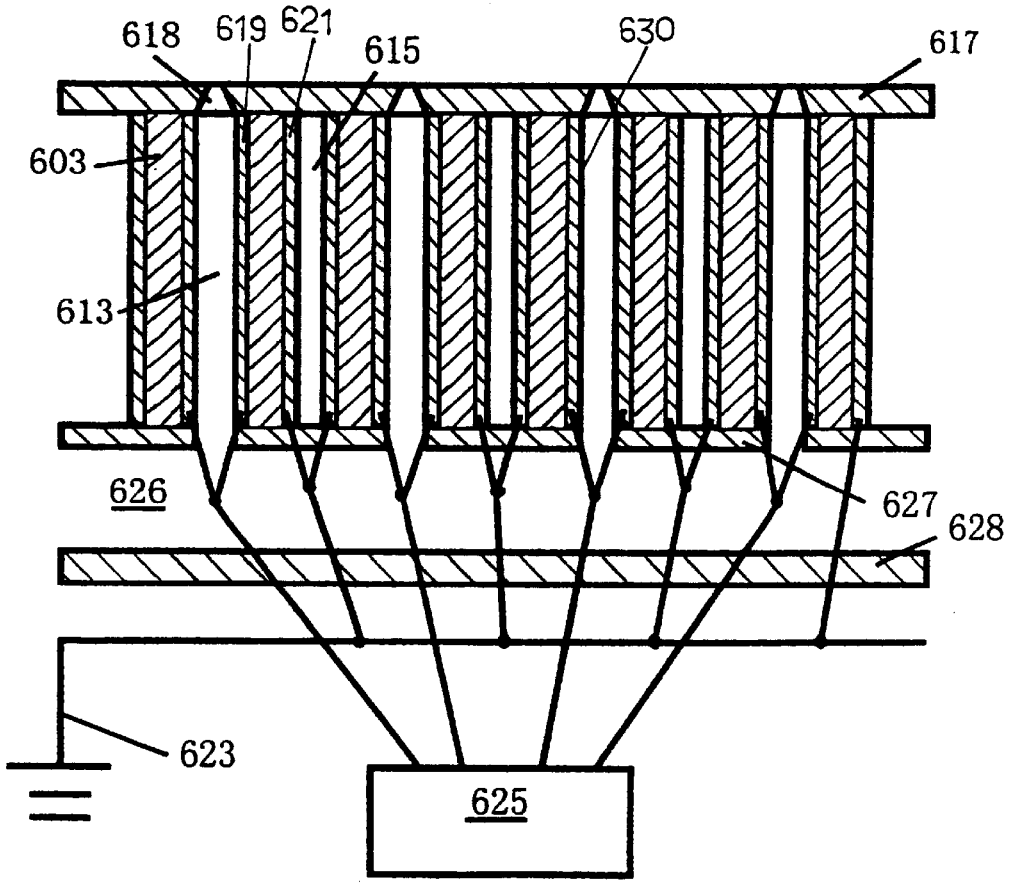
Figure 13:
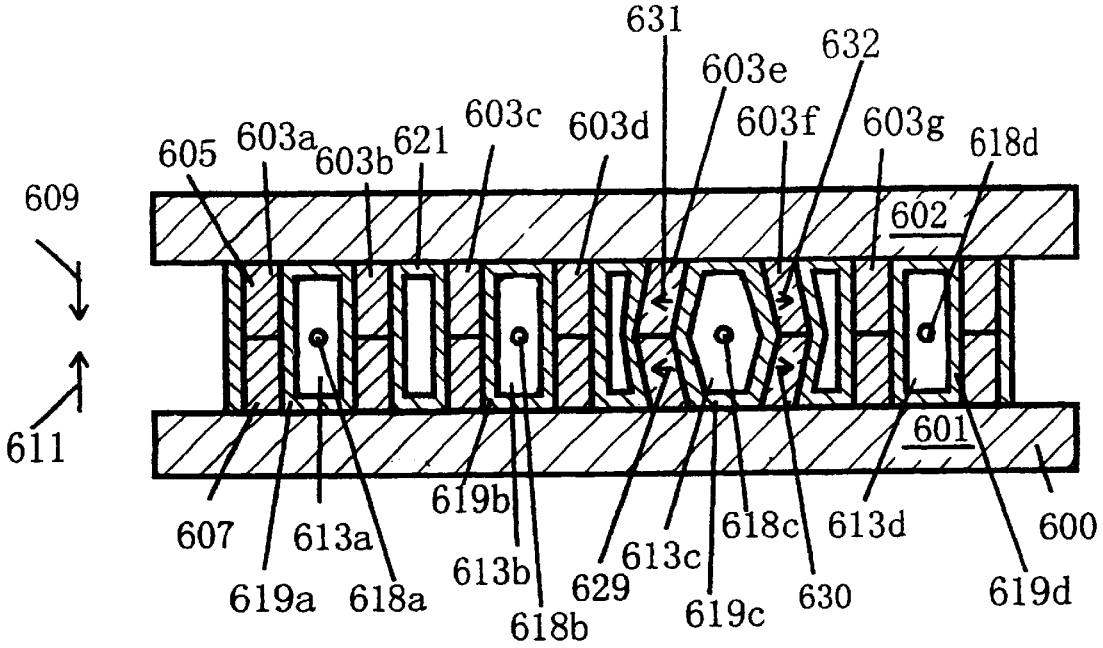
FIG. 13 is a longitudinal sectional view showing the operation of the ink jet portion in the printing head.

The following description is now provided about the discharge circuit 184. The discharge circuit 184 comprises resistors R106, R107 and a transistor TR103. When an ON signal (+5V) is applied to an input terminal 183, the transistor TR103 turns conductive via resistor R106 and the terminal 191A on the resistor R120 side of the capacitor 191 is grounded via resistor R120, so that the electric charge imposed on the actuator wall 603 of the ink chamber 613, shown in FIGS. 12A, 12B and 13, is discharged.

Figure 10:
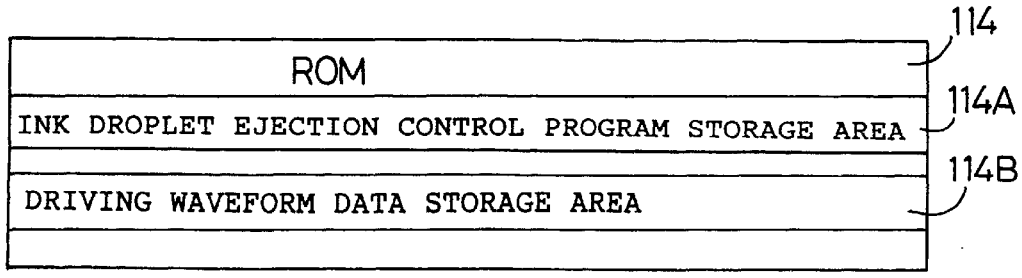
FIG. 10 is a diagram showing storage areas of a ROM used in a controller of the ink droplet ejecting apparatus.

Reference will now be made to the pulse control circuit 186 which generates pulse signals to be received by the input terminal 181 of the charging circuit 182 and the input terminal 183 of the discharge circuit 184. Provided in the pulse control circuit 186 is a CPU 110 which performs various arithmetic operations. To the CPU 110 are connected a RAM 112 for the storage of printing data and various other data and a ROM 114 which stores sequence data for generating ON-OFF signals in accordance with control program and timing in the pulse control circuit 186. In the ROM 114, as shown in FIG. 10, there are provided an area 114A for the storage of ink droplet ejection control program and an area 114B for the storage of driving waveform data. Thus, sequence data of driving waveforms are stored in the area 114B.

The CPU 110 is further connected to an I/O bus 116 for transmission and reception of various data, and to the I/O bus 116 are connected a printing data receiving circuit 118 and pulse generators 120, 122. The output of the pulse generator 120 is connected to the input terminal 181 of the charging circuit 182, while the output of the pulse generator 122 is connected to the input terminal 183 of the discharge circuit 184.

The CPU 110 controls the pulse generators 120, 122 in accordance with the sequence data stored in the driving waveform data storing area 114B of the ROM 114. Therefore, by having various patterns of the foregoing timing stored beforehand in the driving waveform data storing area 114B of the ROM 114, it is possible to apply an appropriate driving pulse of an appropriate driving waveform to the actuator wall 603.

The pulse generators 120, 122, the charging circuit 182 and the discharge circuit 184 are provided in the same number as the number of nozzles used. Although the above description was directed to controlling one nozzle, the same control is applied also to the other nozzles.

Figure 11:
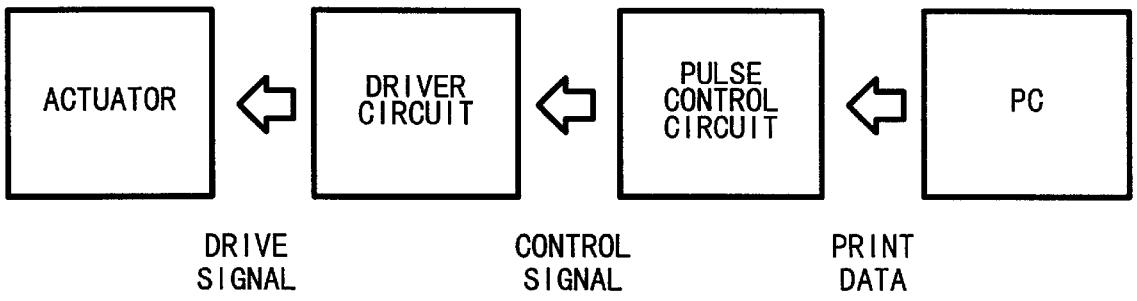
FIG. 11 is a functional block diagram of the controller.

FIG. 11 is a functional block diagram of the controller 625, showing the flow of a printing instruction signal. In FIG. 11, a printing instruction is supplied from a computer, such as a personal computer (PC), or a word processor, to the pulse control circuit 186 (FIG. 9) where it is applied as a control signal to a driver circuit (the charging circuit 182 and the discharge circuit 184). That is, the printing instruction passes through the printing data receiving circuit 118 and is stored in RAM 112. The CPU 110 using control routines and data stored in ROM 114 outputs signals to the pulse generators 120, 122 on the basis of the processed printing instruction. The output of the pulse generators 120, 122 controls the charging and discharge circuits 182, 184 to drive an actuator which is an ink channel 613 and represented by capacitor 191. In this case, the controller 625 stores in RAM 112 beforehand where there has been ejection of ink before each dot and then changes the driving waveform in the manner described above in accordance with whether the answer is affirmative or negative and on the basis of the data read from the ROM.

Although the invention has been described above by way of embodiments thereof, the invention is not limited thereto. For example, a drive signal having only one jet pulse A has been shown above as a main drive signal, which signal, however, may comprise two jet pulses for example. Also the structure of the ink droplet ejecting apparatus 600 it is not limited to the structure adopted in the above embodiments. There may be adopted even one which is opposite in polarizing direction of the piezoelectric material.

Although in the above embodiments air chambers 615 are provided on both sides of each ink chamber 613, ink chambers may be formed directly adjacent each other without forming an air chamber therebetween. Further, although a shear mode type actuator was used in the above embodiments, there may be adopted a structure wherein layers of a piezoelectric material may be laminated together and a pressure wave is generated by deformation in the laminated direction. No limitation is placed on the piezoelectric material. Any other material may be used insofar as it generates a pressure wave in each ink chamber.

What is claimed is:

1. An ink droplet ejecting method wherein a jet pulse signal is applied to an actuator which is for changing the volume of an ink chamber filled with ink, to generate a pressure wave within the ink chamber, thereby applying pressure to the ink and allowing a droplet of the ink to be ejected from a nozzle, wherein on the basis of whether there is ejection of ink just before and just after one dot, a driving waveform which forms the one dot is modified.

2. The ink droplet ejecting method, according to claim 1, wherein at least two types of driving waveforms are provided in advance as jet pulse signals to be applied to the actuator at a predetermined cyclic timing in accordance with a one dot or a plurality of continuous dots printing instruction, and any of said pre-provided driving waveforms is selected on the basis of whether there is the ejection of ink just before and just after the one dot.

3. The ink droplet ejecting method according to claim 1, wherein if there is ejection of ink just after the one dot, ink ejection is performed using a first driving waveform comprising one or a plurality of jet pulses, while if there is no ejection of ink just after the one dot, is performed using a second driving waveform which comprises said first driving waveform and a non-jet pulse added after the first driving waveform.

4. The ink droplet ejecting method according to claim 1, wherein if there is ejection of ink just before the one dot and there is no ejection of ink just after the one dot, the wave width of the jet pulse is shifted from an odd-multiple of a time T required for one-way propagation of the pressure wave through the ink chamber, and in other cases the wave width of the jet pulse is set at an odd-multiple of the one-way propagation time T.

5. The ink droplet ejecting method according to claim 1, wherein if there is ejection of ink just before and just after the one dot, ink ejection is performed at a frequency at which the ink droplet ejecting speed remains the same or increases, and in other cases ink ejection is performed at a frequency at which the ink droplet ejecting speed decreases.

6. An ink droplet ejecting apparatus, including:

an ink chamber filled with ink;

an actuator for changing the volume of the ink chamber;

a driving power source for applying an electric signal to said actuator; and a controller which provides control so that a jet pulse signal is applied to the actuator from the driving power source to increase the volume of the ink chamber and thereby generate a pressure wave in the ink chamber, so that when the time required for one-way propagation of the pressure wave through the ink chamber is assumed to be T, the volume of the ink chamber is decreased from the increased state to a normal state after the lapse of an odd-multiple of the time T, thereby applying pressure to the ink present in the ink chamber and allowing an ink droplet to be ejected, wherein the controller provides control so that in accordance with a one-dot printing instruction and on the basis of whether there is ejection of ink just before and just after the one dot, a driving waveform which forms the one dot is deformed and a jet pulse signal of the driving waveform is applied to the actuator from the driving power source.

7. The ink droplet ejecting apparatus according to claim 6, wherein two to four types of driving waveforms are provided in advance as jet pulse signals to be applied to the actuator at a predetermined cyclic timing in accordance with a one dot or plural continuous dots printing instruction, and any of the pre-provided driving waveforms is selected on the basis of whether there is ejection of ink just before and just after one dot.

8. The ink droplet ejecting apparatus according to claim 6, wherein if there is ejection of ink just after the dot, ink ejection is performed using a first driving waveform comprising one or a plurality of jet pulses, while if there is no ejection of ink just after the dot, ink ejection is performed using a second driving waveform which comprises the first driving waveform and a non-jet pulse added after the first driving waveform.

9. The ink droplet ejecting apparatus according to claim 6, wherein if there is ejection of ink just before the dot and there is no ejection of ink just after the dot, the wave width of the jet pulse is shifted from an odd-multiple of time T required for one-way propagation of the pressure wave through the ink chamber, and in other cases the wave width of the jet pulse is set at an odd-multiple of the one-way propagation time T.

10. The ink droplet ejecting apparatus according to claim 6, wherein if there is ejection of ink just before and just after the dot, ink ejection is performed at a frequency at which the ink droplet ejecting speed remains the same or increases, and in other cases ink ejection is performed at a frequency at which the ink droplet ejecting speed decreases.

11. An ink ejecting printer, comprising:

an ink ejecting printhead having a plurality of ink ejection nozzles and associated ink chambers; and a controller for controlling ejection from each nozzle, wherein control of ejection of a current dot involves modifying ejection control on a basis of whether an ink dot is ejected before, after or both before and after the current dot which define print conditions for the current dot which define print conditions for the current dot.

12. The ink ejecting printer according to claim 11, wherein the ejection control is modified by changing a driving waveform.

13. The ink ejecting printer according to claim 12, wherein the printer further comprises a non-volatile memory storing a plurality of driving waveforms, each stored driving waveform associated with a print condition of the current dot.

14. The ink ejecting printer according to claim 11 wherein the ejection control is modified by changing a driving frequency.

15. The ink ejecting printer according to claim 14, wherein the printer further comprises a non-volatile memory storing a plurality of driving frequencies, each stored driving frequency associated with a print condition of the current dot.

* * * * *